United States Patent [19]

Vallejo, Jr.

[11] Patent Number: 4,809,671

[45] Date of Patent: Mar. 7, 1989

[54] PORTABLE GAS-FIRED COOKING UNIT

[76] Inventor: Edward Vallejo, Jr., 1420 Palacios St., El Campo, Tex. 77437

[21] Appl. No.: 106,387

[22] Filed: Oct. 9, 1987

[51] Int. Cl.[4] ..... F24C 3/08

[52] U.S. Cl. ..... 126/39 R; 126/25 R; 126/41 R; 126/40; 126/44; 126/50

[58] Field of Search ..... 126/25 R, 39 R, 37 B, 126/50, 40, 41 R, 44, 2

[56] References Cited

U.S. PATENT DOCUMENTS

| | | | |
|---|---|---|---|
| 384,391 | 6/1888 | Rein | 126/44 |
| 605,011 | 5/1898 | Pringle | 126/39 R |
| 732,470 | 6/1903 | Tatham | 126/39 R |
| 1,428,790 | 9/1922 | Lindhorst | 126/44 |
| 1,879,515 | 9/1932 | Routt | 126/40 |
| 3,140,740 | 7/1964 | Lagreid et al. | 126/44 X |
| 3,692,013 | 9/1972 | Grafton et al. | 126/25 R |
| 3,773,458 | 11/1973 | Spotts | 126/44 X |

*Primary Examiner*—Samuel Scott
*Assistant Examiner*—Carl D. Price
*Attorney, Agent, or Firm*—Leon Gilden

[57] ABSTRACT

An improved gas-fired cooking unit includes an easily adjustable and removable wind shield positionable next to a pair of relatively movable burners. A fixed burner is positioned beneath a cooking pan to which the wind shield is attachable, and a second auxiliary burner is either rotatably or fixedly attached to the cooking unit and is designed to support a separate cooking pan.

1 Claim, 4 Drawing Sheets

PORTABLE GAS-FIRED COOKING UNIT

BACKGROUND OF THE INVENTION

1. Field of the Invention

The present invention relates to gas-fired cooking assemblies, and more particularly pertains to a new and improved portable gas-fired cooking grill which utilizes two separately usable burners.

2. Description of the Prior Art

Gas-fired grills and other similar cooking assemblies are well known in the prior art. A typical example of a gas-fired cooking grill is to be found in U.S. Pat. No. 3,692,013 which issued to Grafton, et al on Sept. 19, 1972. The grill illustrated in this patent is illustrative of the standard arrangement of providing a burner assembly beneath a cooking pan or within a cooking enclosure. This type of grill utilizes a single burner assembly, and where a variety of different foods are to be cooked at one time, such foods can either be positioned over the burner in separate pans or placed on a covering grill wherein direct flame contact is permitted. Of course, the use of a single burner unit entails the provision of a constant supply of heat to the foods to be cooked. As such, it becomes difficult to properly cook different varieties of foods at the same time inasmuch as only a constant temperature cooking range is available. Accordingly, there is a continuing need for new and improved gas fired cooking units which would facilitate the simultaneous cooking of different varieties of foods at different temperatures, and in this respect, the present invention substantially addresses this need.

SUMMARY OF THE INVENTION

In view of the foregoing disadvantages inherent in the known types of gas-fired cooking units now present in the prior art, the present invention provides an improved gas-fired cooking unit wherein the same facilitates the simultaneous cooking of different foods at different temperatures. As such, the general purpose of the present invention, which will be described subsequently in greater detail, is to provide a new and improved gas-fired cooking unit which has all the advantages of the prior art gas-fired cooking units and none of the disadvantages.

To attain this, the present invention includes a first burner unit fixedly secured to a support assembly beneath a cooking enclosure or pan. In a preferred embodiment, a propane gas bottle is directly attached to the first burner unit with an appropriate shutoff valve being utilized to regulate the supplying of gas to the burner. A second burner unit is fixedly secured to an outwardly extending conduit which in turn may be either rotatably or fixedly mounted to the support structure. The second burner unit is also supplied with gas from the propane bottle through the use of a second shutoff valve, and the burner unit is designed to have a cooking pan removably positioned thereon. A selectively positionable and removable wind shield is included as a part of the invention, as is a lid which is designed to completely cover the cooking enclosure associated with the first burner unit.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gas-fired cooking unit which has all the advantages of the prior art gas-fired cooking units and none of the disadvantages.

It is another object of the present invention to provide a new and improved gas-fired cooking unit which may be easily and efficiently manufactured and marketed.

It is a further object of the present invention to provide a new and improved gas-fired cooking unit which is of a durable and reliable construction.

An even further object of the present invention is to provide a new and improved gas-fired cooking unit which is susceptible of a low cost of manufacture with regard to both materials and labor, and which accordingly is then susceptible of low prices of sale to the consuming public, thereby making such gas-fired cooking units economically available to the buying public.

Still yet another object of the present invention is to provide a new and improved gas-fired cooking unit which provides in the apparatuses and methods of the prior art some of the advantages thereof, while simultaneously overcoming some of the disadvantages normally associated therewith.

Still another object of the present invention is to provide a new and improved gas-fired cooking unit which provides for the use of at least two separately controllable and usable burner assemblies.

Yet another object of the present invention is to provide a new and improved gas-fired cooking unit which employs the use of an easily removable and attachable wind shield.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
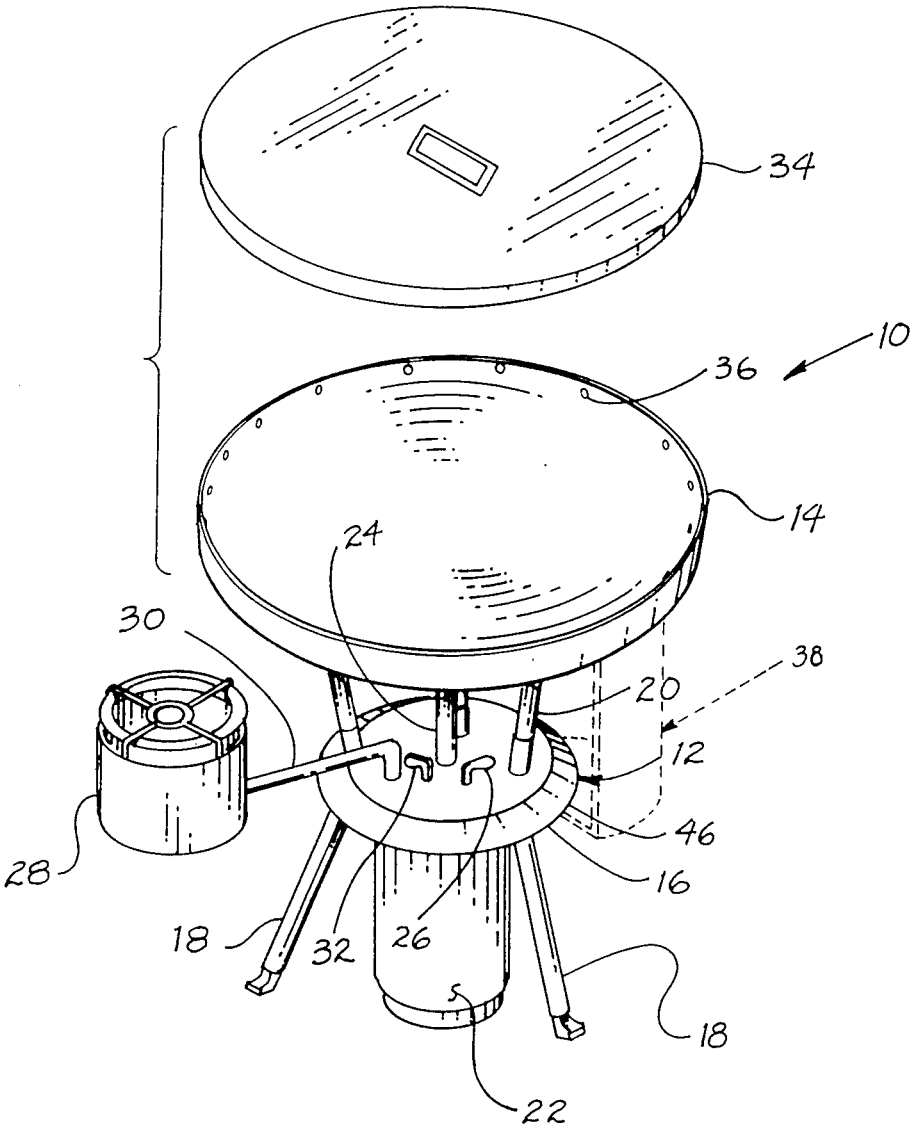
FIG. 1 is an exploded perspective view of the gas-fired cooking unit comprising the present invention.

With reference now to the drawings, and in particular to FIG. 1 thereof, a new and improved gas-fired cooking unit embodying the principles and concepts of the present invention and generally designated by the reference numeral 10 will be described.

More specifically, it will be noted that the gas-fired cooking unit 10 essentially includes a support structure 12 to which a cooking pan or enclosure 14 is fixedly or otherwise secured. The support structure 12 further includes an intermediately disposed plate member 16 to which a plurality of downwardly extending support legs 18 are attached. Extending upwardly from the support plate 16 is a further plurality of support rods 20, and the cooking enclosure 14 is directly supported by these support rods.

A conventional bottled container 22 of compressed propane gas is fluidly connected to a burner unit 24 positioned directly below the cooking enclosure 14. The burner unit 24 can be of any conventional design and facilitates the controlled burning of the propane gas. A first shutoff valve 26 is used to regulate the flow of gas from the bottle 22 to the burner unit 24.

As further illustrated in FIG. 1 of the drawings, second burner 28 is fixedly secured to a gas supply conduit 30 which extends outwardly from the support plate 16. A further gas shutoff valve 32 is utilized to control the flow rate of gas through the conduit 30 to the burner 28. The burner 28 is fixedly secured to the conduit 30, while the conduit may be either rotatably or fixedly mounted to the plate 16, thereby to allow for the adjustable positioning of the burner relative to the cooking enclosure 14. When rotatably mounted, the burner 28 may be selectively positioned under the cooking enclosure 14 to add additional heat thereto during a cooking process, or alternatively, the burner can be moved outwardly from the cooking enclosure in the manner illustrated in FIG. 1. In this outwardly extended position, a user can place a second and separate cooking pan upon the burner unit 28 so that concurrent cooking of different foods can be accomplished. This of course permits a user to adjust the heat rate in the two separate burners 24, 28, thereby to accommodate the cooking requirements of the different foods. Further, the shutoff valves 26, 32 can be positioned beneath the plate 16 if desired, and such positioning of these valves in any convenient location is within the intent and purview of the present invention.

Figure 2:
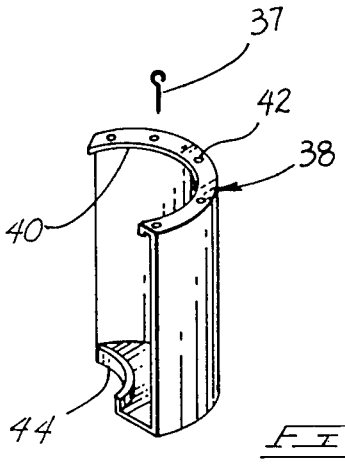
FIG. 2 is a perspective view of a wind shield utilized in the combination of the invention.

FIG. 1 further illustrates a lid 34 which is removably positionable over the cooking enclosure 14. The lid 34 can be used in those situations where it is desired to steam or smoke particular foods and is thus used to increase the versatility of the present invention. Additionally illustrated in FIG. 1 is a plurality of small apertures 36 which are positioned around a rim portion of the cooking enclosure 14. The apertures 36 are designed to receive manually removable optional locking pins 37 which in a preferred embodiment would constitute no more than small lengths of wire having hand gripping loops integrally attached to top portions thereof. As illustrated in FIG. 2, a semi-circular wind shield 38 is designed to be selectively removably attached to the cooking enclosure 14 by the aforementioned locking pins 37.

The removable wind shield 38 includes an inwardly directed flange portion 40 having a plurality of through-extending apertures 42 which are alignable with the apertures 36 in the cooking enclosure 14. Additionally, the wind shield 38 includes a bottom positioned, upwardly extending flange 44 which is positionable beneath a circumferential lip portion 46 forming a part of the intermediate support plate 16. As such, the flange 44 provides for a bottom fixed support of the wind shield 38 when the apertures 42 are aligned with the apertures 36. One or more locking pins 37 can then be inserted through the aligned apertures 36, 42 to securely hold the wind shield 38 in position. As can be appreciated, the wind shield 38 prevents moving air from extinguishing flames associated with the burners 24, 28.

Figure 3:
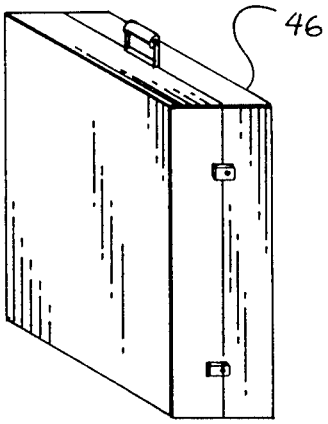
FIG. 3 is a perspective view of a carrying case in which the invention can be stored.

FIG. 3 of the drawings illustrates a compact carrying case 46 into which the cooking grill 10 can be compactly stored when in a disassembled condition. In this connection, the carrying case 46 is illustrative of any type of storage means which could be used in combination with the present invention, and all such carrying and storing assemblies are within the intent and purview of the claims annexed hereto.

Figure 4:
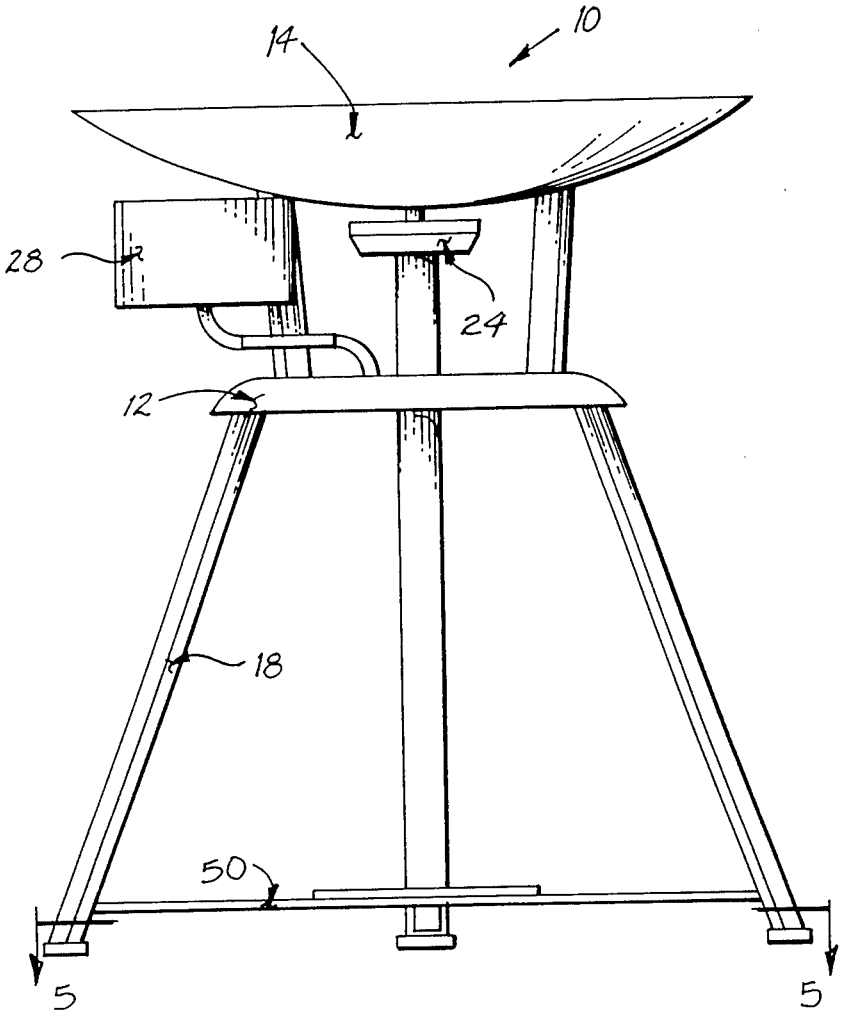
FIG. 4 is a side elevation view of a modified embodiment of the invention.
Figure 5:
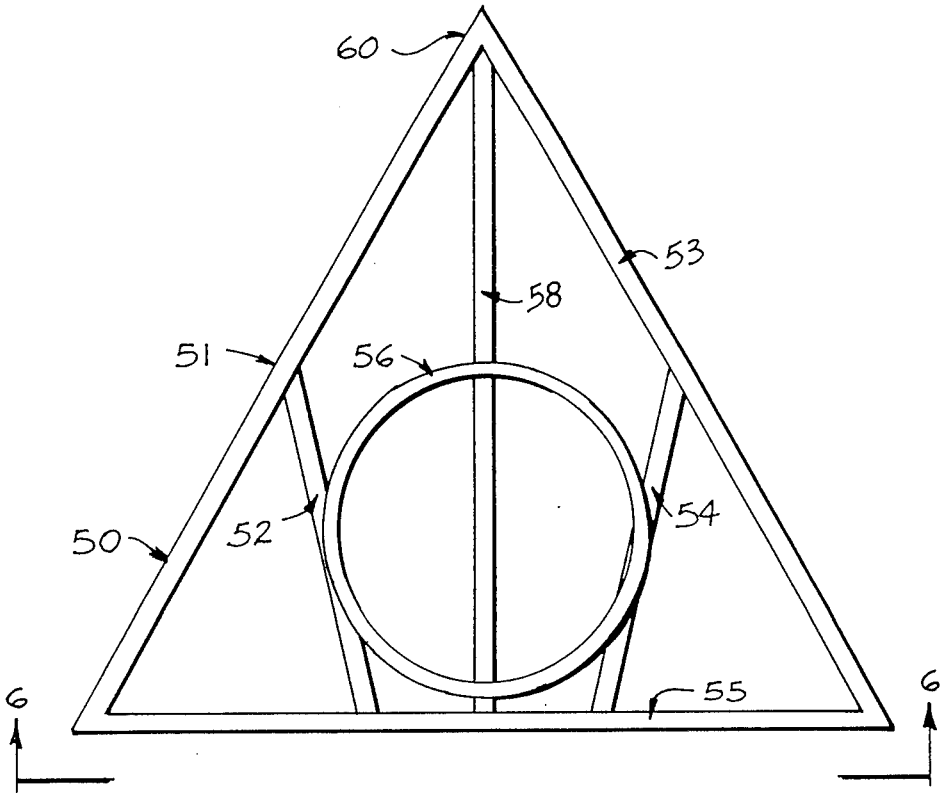
FIG. 5 is a top plan view of the invention taken along the line 5—5 in FIG. 4.
Figure 6:
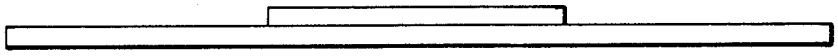
FIG. 6 is a side elevation view of the invention taken along the line 6—6 in FIG. 5.

FIGS. 4, 5 and 6 illustrate a slightly modified embodiment of the present invention 10. More specifically, the grill 10 is shown with a bottomly positioned, triangularly shaped brace assembly 50 which is fixedly secured between the three grill legs 18. The assembly 50 may be attached to the legs 18 by any conventional means, such as by welding or the like, and the brace assembly essentially consists of three rigid members 51, 53, 55 fixedly attached together. Extending between the rigid members 51, 55 is a further brace member 52 which is fixedly secured thereto. Similarly, a brace member 54 is fixedly secured between the members 53, 55, and a rigid ring member 56 is attached between the members 52, 54. The ring member 56 is sized to receive the aforedescribed propane bottle 22 in a supporting manner, and if desired, a further rigid member 58 can be attached beneath the ring member. The member 58 can extend from an apex 60 formed by the connection of the members 51, 53 and an intermediate portion of the member 55.

As to the manner of usage and operation of the present invention, the same should be apparent from the above description. Accordingly, no further description of the manner of usage and operation will be provided.

In summary, it can be appreciated that the present invention is primarily designed to be used as a method of cooking meats and vegetables in any combination, while being equally adaptable for use when a food preparation calls for a sauteing method. The grill 10 can be modified for use with charcoal for grilling meats, fowl or fish, vegetables, etc., while a simple changing of the burner orifices would allow a conversion to natural gas. With a shorter leg base, the grill could be changed so as to be used in combination with a wood fire. In the preferred embodiment, a sturdy cast steel disk construction is employed to provide for an even distribution of heat which then requires the use of less bottled gas during the cooking process. The auxiliary mounted small burner 28 can be utilized without heating the main unit and is ideal for the preparation of early morning camp coffee or as a side burner for sauces, etc., during a concurrent use of the main unit. It is also within the concept of the present invention to utilize a non-stick Teflon finish on the cooking surface of the disk 14 which would then provide for a quick cleaning thereof while eliminating the need for cooking oils and the like.

What is claimed as being new and desired to be protected by Letters Patent of the United States is as follows:

1. A fuel-firing cooking unit comprising:

cooking disk means for supporting food to be cooked;

first burner means positioned vertically below and positioned proximate to said cooking disk means to supply heat to the cooking disk means;

fuel supply means for supplying fuel to said first burner means;

auxiliary burner means positioned proximate said cooking disk means and being supplied by said fuel from said fuel supply means;

wherein said support means includes a support plate positioned vertically below said disk means, said support plate supporting said first burner means, said auxiliary burner means and said cooking disk means, said support plate including a first valve means for controlling a supply of said fuel to said first burner means and a second valve means for controlling a supply of said fuel to said auxiliary burner means; and further including a wind shield including means for attaching said wind shield to said cooking disk means; and wherein said means for attaching said wind shield to said cooking disk means includes manually removable pins; and wherein said pins are positioned through aligned apertures in said wind shield and said cooking disk means; and wherein said wind shield is further formed with an integral flange means, said flange means being engaged with a circumferential lip on said support plate when said pins are positioned through said aligned apertures.

* * * * *